US007618046B2

(12) United States Patent
Green

(10) Patent No.: US 7,618,046 B2
(45) **Date of Patent: *Nov. 17, 2009**

(54) ROLLER SKATE AND WHEEL TRUCKS THEREFOR

(75) Inventor: Brian J. Green, Manhattan Beach, CA (US)

(73) Assignee: Triskate Technology, LLC, Oakview, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/581,242

(22) Filed: Oct. 16, 2006

(65) Prior Publication Data

US 2007/0052184 A1 Mar. 8, 2007

Related U.S. Application Data

(62) Division of application No. 10/923,222, filed on Aug. 20, 2004, now Pat. No. 7,121,561.

(60) Provisional application No. 60/497,884, filed on Aug. 25, 2003, provisional application No. 60/537,273, filed on Jan. 16, 2004.

(51) Int. Cl.
*A63C 17/00* (2006.01)

(52) U.S. Cl. ..... 280/11.19; 280/11.27

(58) Field of Classification Search ..... 280/11.19, 280/11.204, 11.208, 11.209, 11.221, 11.231, 280/11.27, 11.28; D21/763
See application file for complete search history.

(56) References Cited

U.S. PATENT DOCUMENTS

| | | | | |
|---|---|---|---|---|
| 1,617,984 | A * | 2/1927 | Biggio | 280/11.19 |
| 1,632,997 | A * | 6/1927 | Connolly | 280/11.19 |
| 2,474,082 | A * | 6/1949 | Wutz | 280/11.19 |
| 4,272,091 | A * | 6/1981 | Reid, Jr. | 280/11.28 |
| 4,523,767 | A * | 6/1985 | Le Page | 280/11.19 |
| 5,224,718 | A * | 7/1993 | Gertler | 280/11.19 |
| 5,551,713 | A * | 9/1996 | Alexander | 280/11.19 |
| 5,908,196 | A * | 6/1999 | Weiss | 280/11.19 |
| 6,406,039 | B1 * | 6/2002 | Chen | 280/11.27 |
| 6,439,584 | B1 * | 8/2002 | Lai | 280/11.27 |
| 6,679,505 | B2 * | 1/2004 | Yang | 280/11.19 |
| 7,121,561 | B2 * | 10/2006 | Green et al. | 280/11.19 |
| 2003/0057665 | A1 * | 3/2003 | Matney | 280/11.231 |

* cited by examiner

*Primary Examiner*—Christopher Bottorff
(74) *Attorney, Agent, or Firm*—Russo & Duckworth, LLP

(57) ABSTRACT

A roller skate having enhanced steerability and stability is disclosed. The skate includes a platform for supporting a skater's foot and front and rear wheel trucks secured to the underside of the platform. A pair of front wheels is rotatably mounted in transverse axial alignment on the front wheel truck and a pair of rear wheels is rotatably mounted in transverse axial alignment on said rear wheel truck. The pairs of front and rear wheels are also in parallel axial alignment with each other and mounted on their respective wheel trucks for resiliently controlled, tilting movement about downwardly inclined longitudinal axes. In addition, a fifth wheel is rotatably mounted on the front wheel truck between the pairs of front and rear wheels and in parallel axial alignment with the wheel pairs.

7 Claims, 6 Drawing Sheets

ROLLER SKATE AND WHEEL TRUCKS THEREFOR

CROSS REFERENCE TO RELATED APPLICATION

This application is a divisional application of U.S. patent application Ser. No. 10/923,222, filed on Aug. 20, 2004, now U.S. Pat. No. 7,121,561 issued Oct. 17, 2006, which in turn, is a continuation application claiming the benefit under 35 USC 119(e) of U.S. provisional application Ser. No. 60/497,884, filed on Aug. 25, 2003 and U.S. provisional application Ser. No. 60/537,273, filed on Jan. 16, 2004.

FIELD OF THE INVENTION

The present invention relates to wheeled skates and more particularly to wheeled skates adapted to be removably mounted on a skater's footwear. The invention further relates to wheel trucks for mounting wheels on skates, skate boards, scooters and the like.

Prior Art

U.S. Pat. No. 4,351,538 shows an expandable roller skate with toe and heel plates and toe and instep straps for securing the skate on a skater's shoe.

U.S. Pat. No. 1,771,855 shows an expandable strap-on roller skate with wheels positioned in front of the toe plate and in back of the heel plate.

U.S. Pat. No. 5,620,190 shows an expandable strap-on skate with front and rear brake pads.

U.S. Pat. No. 6,217,039 shows an expandable strap-on skate with buckles for securing the straps.

U.S. Pat. No. 5,551,713 shows a skate with a pair of rear wheels and two in-line front wheels and front and rear stops or brakes.

U.S. Published Patent Application No. 2003/0116930 discloses a roller skate having a tiltable pair of front wheels and a single rear wheel.

In addition, a search for information related to the present invention uncovered the following documents: U.S. Pat. Nos. 6,481,726; 6,431,559; 6,209,889; 5,826,895; 5,224,718; 4,572,529; 4,382,605; 4,272,090; 1,975,905; 1,809,612; 1,609,612; 1,271,891 and 177,566 and U.S. Published Patent Application Nos. 2003/0057670; 2003/0057665; 2003/0052463 and 2002/0030332.

BRIEF DESCRIPTION OF THE DRAWINGS

The invention will be more readily understood by reference to the accompanying drawings wherein like reference numerals indicate like elements, and in which.

SUMMARY OF THE INVENTION

Figure 1:
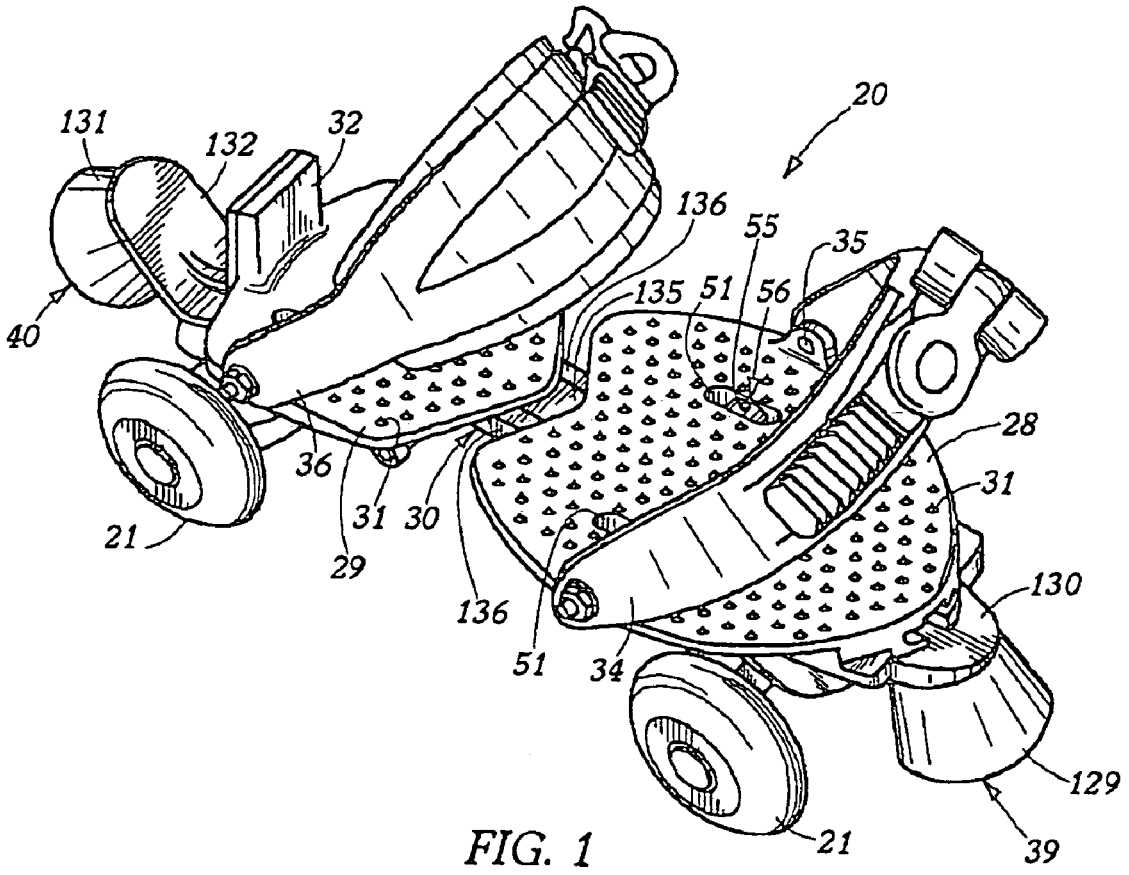
FIG. 1 is a top front perspective view of a roller skate embodying the present invention.
Figure 2:
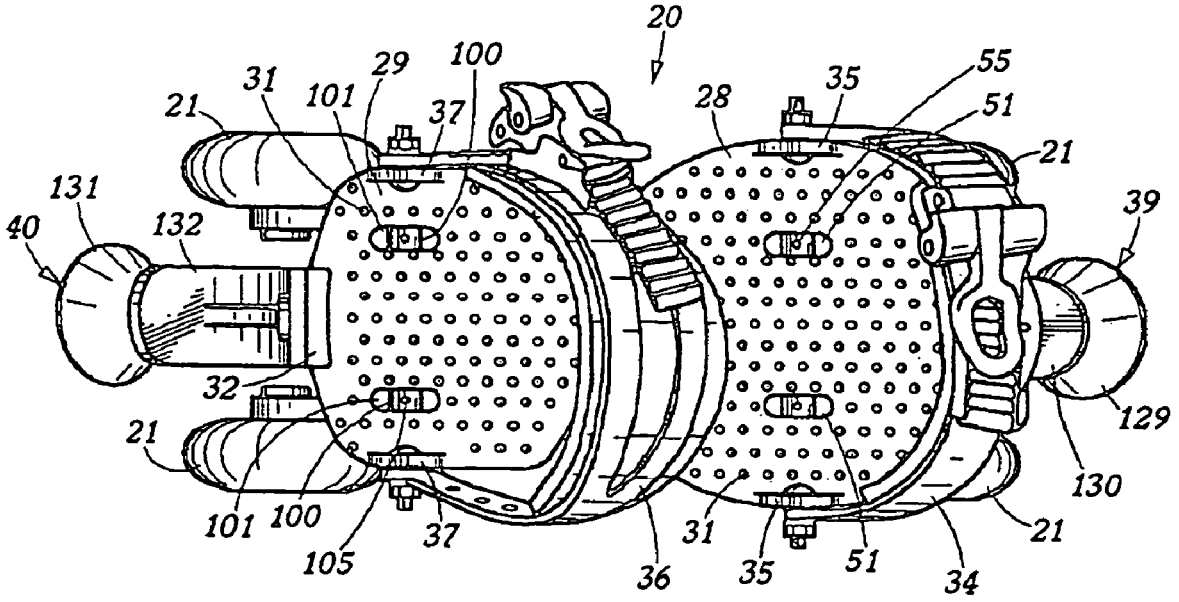
FIG. 2 is a top plan view thereof.

The present invention provides a roller skate which is adapted to be strapped onto or removably mounted on a skater's street shoe, sneaker or the like. In its broadest sense, the roller skate includes a platform for supporting a skater's foot and front and rear wheel trucks which are mounted on the underside of the platform. The front wheel truck includes a pair of front wheels rotatably mounted on the front wheel truck in transverse axial alignment relative to the longitudinal direction of the platform. The rear wheel truck also preferably includes a pair of rear wheels (although one wheel will also work as described in more detail infra) which are also rotatably mounted on the rear wheel truck in transverse axial alignment. The pairs of front and rear wheels are also in parallel axial alignment with each other. In addition, a fifth but single (i.e. not paired) center wheel is provided which is rotatably mounted between the pairs of front and rear wheels and in parallel axial alignment with said pairs of wheels.

In a preferred embodiment, the pair of front wheels is mounted on its respective wheel truck, i.e. the front wheel truck, for tilting or pivotal movement about a longitudinal axis, preferably a downwardly inclined longitudinal axis. A damping pad is provided which is mounted on the front wheel truck for resiliently controlling the tilting of the pair of front wheels about the longitudinal axis. In addition, the fifth but single center wheel is rotatably mounted on the front wheel truck. This preferred embodiment is advantageous in that it enhances the skater's ability to steer the skate and also enables the skater to generate more power with each thrust of the skate.

In an even more preferred embodiment, the pair of rear wheels is also made tiltable or pivotal about a longitudinal axis, preferably a downwardly inclined longitudinal axis. Tilting of the rear wheels further enhances the skater's ability to steer since the rear wheels not only tilt when the skater initiates a turn but do so in a direction opposite that of the front wheels which makes it even easier for a skater to execute a turn, particularly a quick turn. The rear wheel truck also includes a damping pad for resiliently controlling the tilting of the pair of rear wheels about the longitudinal axis. A four wheeled skate with only one rear wheel is also described as is a three wheeled skate which does not utilize the center wheel.

The above summary describes preferred forms of the present invention and is not in any way to be construed as limiting the claimed invention to the preferred forms.

DETAILED DESCRIPTION OF THE DRAWINGS

The present invention is embodied in a roller skate 20 and particularly in a skate of the type adapted to be strapped on to or removably mounted on a skater's street shoe, sneaker or the like. The roller skate is basically a four wheel or quad type roller skate with four wheels 21 arranged in a quadrangle, but includes a fifth wheel 22 for assisting in pushing to propel the skater, and to improve the skater's balance. The skate includes front wheel trucks 24 and rear wheel trucks 25 that, while finding particular utility on a roller skate, are also adaptable for use on skate boards, scooters and the like (not shown). While the invention is described herein in the context of a strap-on roller skate, it is also applicable to boot mounted skates.

The skate includes a longitudinally adjustable platform 26 formed of a toe plate 28 and a heel plate 29 coupled to the toe plate by a telescoping platform length adjuster 30 so that the length of the skate platform 26 can be adjusted to fit a skater's foot and shoe. In order to prevent the skater's foot from slipping relative to the toe and heel plates 28, 29, the upper surface of the plates includes rows of teeth or barbs 31. An upstanding heel panel or cup 32 is provided for engaging the skater's heel and preventing it from slipping from the heel plate 29.

A front quick clamp releasable strap 34 is secured to upstanding strap bosses 35 on opposite sides of the toe plate 28 and adapted to engage and secure the users foot to the skate toe plate. A similar quick connect releasable strap 36 is secured to upstanding strap bosses 37 on the heel plate 29 and adapted to pass over the skater's instep for securing the skaters foot and heel to the heel plate 29. The straps are of the type well-known for securing bindings of skates, snow boards and skis.

The front wheel truck 24 is secured to the underside of the toe plate 28 and the rear wheel truck 25 is secured to the underside of the heel plate 29. To assist the skater in stopping, a front brake 39 is mounted on the toe plate 28 and a rear brake 40 is mounted on the heel plate 29.

The front wheel truck 24 is formed by an L-shaped mounting bracket 42 (FIGS. 8, 9) having a horizontal plate 43 adapted to be secured to the underside of the toe plate 28 and a depending vertical plate 44 integral with the horizontal plate 43 and defining on its inner face 45 a convex spherical bearing surface 46. The horizontal plate 43 is secured to the underside of the toe plate 28 for pivotal movement about a transverse axis which is generally perpendicular to the longitudinal axis of platform 26 by a pair of mounting pins 48 attached at one end to the horizontal plate 43 of the mounting bracket by machine screws 49 and having eyelets 50 at their other end extending through vertical elongated slots 51 defined in spaced apart corresponding segmentally shaped ribs 52 on the underside of the toe plate 28, the slots 51 opening through the upper surface of the toe plate 28. The eyelets 50 receive mounting pins 54 extending laterally through the ribs and secured to the eyelets 50 by setscrews 55 extending through the upper edge of the eyelet 50 and accessible through the openings of the slots 51 in the toe plate. Pins 54 which, as indicated, are received in eyelets 50 allow plate 43 to pivot about an axis defined by pins 54 which is transverse to the platform's longitudinal axis.

Figure 4:
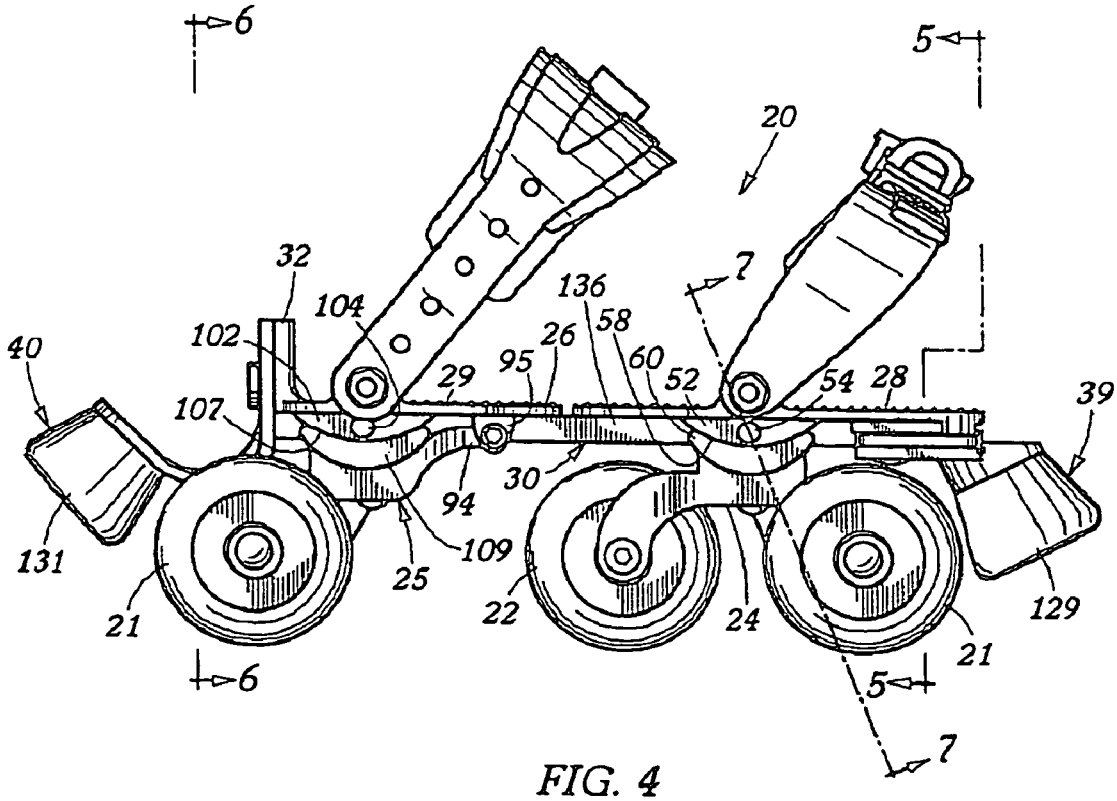
FIG. 4 is a side elevation view thereof.

The mounting ribs 52 as shown in FIG. 4 also define convexly curved outer surfaces 58, and the horizontal plate 43 of the L-shaped front mounting bracket 42 defines corresponding concavely curved surfaces 59 adapted to receive arcuate resilient damping pads or cushions 60 which provide shock absorbing, vertical cushioning of the wheel mounting on the skate plate. As will be appreciated, the shock absorbing, resilient pad is engaged to absorb shock when plate 43 of the wheel truck is pivoted in either direction about the transverse axis defined by pins 54. This type of pivoting action could occur if, for example, the skater is skating on rough terrain or encounters an obstruction such as rock or twig.

For mounting a pair of front wheels 21 on the front truck 24 in tiltable relation to the toe plate 28, a wheel axle yoke 61 is pivotally secured to the vertical plate 44 of the L-shaped mounting bracket 42 by a pivot pin 62. The wheel axle yoke 61 is formed by a central web portion 64 and opposed arms 65 extending from the sides thereof. The side arms 65 include apertures 66 therein mounting bushings 68 through which axle pins 69 extend and are secured by machine bolts 70. The wheels 21, which may have internal bearings 71 are mounted and supported on the axles defined by the pins 69. The yoke 61 is pivotally mounted on the vertical plate 44 of the front mounting bracket 42. To this end, the yoke web 64 defines a concave spherical bearing surface 72 corresponding to and receiving the convex spherical surface 46 on the vertical mounting plate 44. The pivot pin 62 extends through corresponding apertures 75, 76 respectively in the bracket plate 44 and yoke web 64. The apertures 75, 76 and pivot pin 62 are aligned along an axis 78 (FIG. 8) that is inclined at an acute angle downwardly and rearwardly with respect to the horizontal plane of the toe plate 28. The inclined pivot axis 78 and spherical bearing surfaces 46, 72 enable the wheels 21 to tilt (i.e. pivot about the axis) and turn when the skater leans one way or the other. The tilting movement is limited and controlled by a resilient U-shaped damping pad 79 mounted in a slot 80 in the horizontal plate 43 of the bracket, into which extends a tang 81 integral with the web of the wheel yoke 61. By varying the hardness and resiliency, conventionally expressed as the durometer of the material, of the resilient damping pad 79, the swinging motion of the yoke 61 and pair of front wheels 21 can be controlled to suit the skater.

For providing stability to the skate, and to assist the skater in pushing with one skate or the other to increase the speed of skating, a fixed axis, and preferably non-tilting, third front wheel 22 (firth wheel overall) is supported beneath the toe plate 28 between mounting arms 84 extending rearwardly from the horizontal plate 43 of the mounting bracket 42. The wheel 22 is rotatably supported on an axle pin 85 and can move vertically with the mounting bracket 42 but does not swing or tilt. The axle pin 85 is secured between the arms 84 by a machine screw 86. The wheel 22 provides stability to the front skate truck and skate when the skater is turning or pushing.

Figure 8:
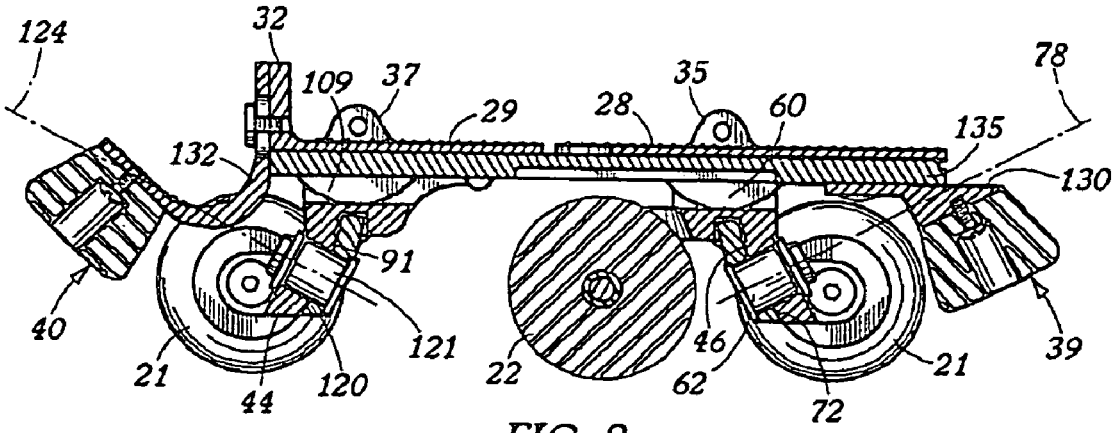
FIG. 8 is a section view taken substantially in the plane of line 8-8 on FIG. 5.
Figure 9:
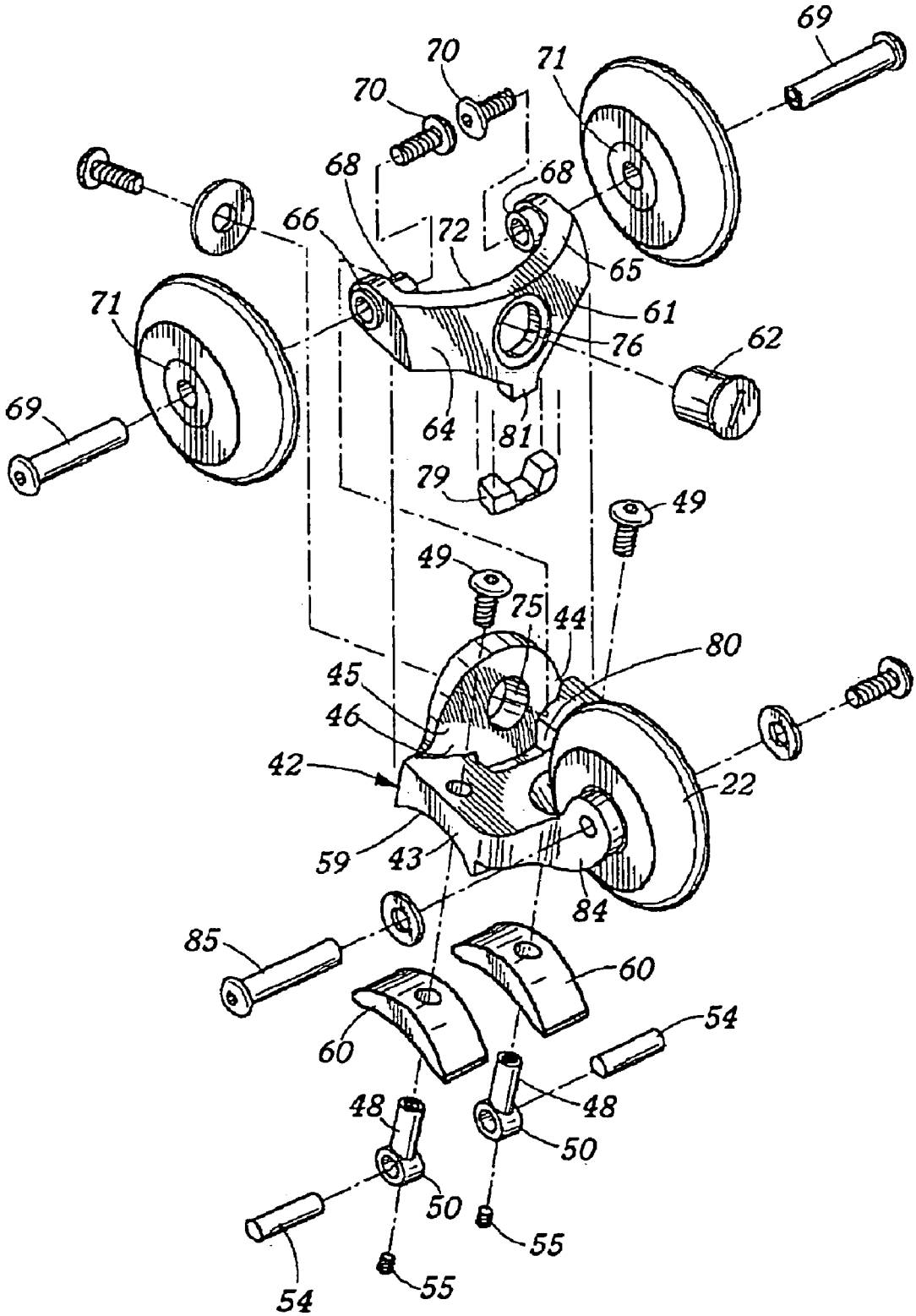
FIG. 9 is an upside-down perspective exploded view of the front wheel truck of the skate embodying the present invention.
Figure 10:
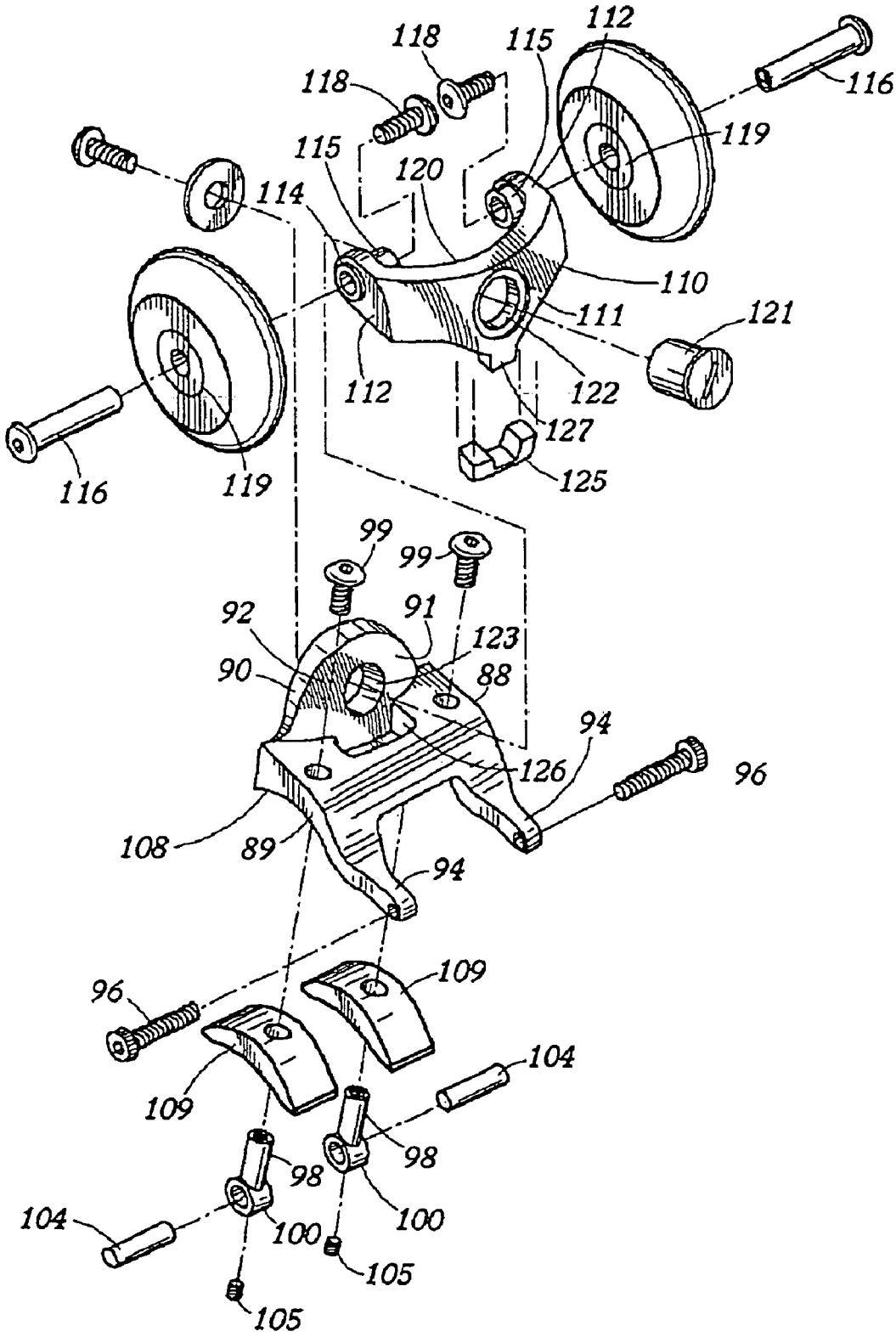
FIG. 10 is an upside-down perspective exploded view of the rear wheel truck of the skate embodying the present invention.

The rear wheel truck 25 is somewhat similar in construction to the front wheel truck 24 and includes an L-shaped rear mounting bracket 88 having a horizontal plate 89 adapted to be secured to the underside of the heel plate 29 and a depending vertical plate 90 integral with the horizontal plate 89 and defining on its inner face 91 a convex spherical bearing surface 92 (FIGS. 8 and 10). A pair of mounting arms 94 extend from the sides of the horizontal plate 89 and are pivotally engaged with bosses 95 projecting from the underside of the heel plate 29 by pivot machine screws 96. The horizontal plate 89 is further secured to the underside of the heel plate 29 by a pair of mounting pins 98 attached at one end to the horizontal plate 89 of the mounting bracket 88 by machine screws 99 and having eyelets 100 at their other end extending through vertical elongated slots 101 defined in spaced apart corresponding segmentally shaped ribs 102 on the underside of the heel plate 29, the slots 101 opening through the upper surface of the heel plate 29. The eyelets 100 receive mounting pins 104 secured to the eyelets by setscrews 105 extending through the upper edge of the eyelet 100 and accessible through the openings of the slots 101 in the heel plate 29. The mounting ribs 102 define convexly curved outer surfaces 107, and the horizontal plate 89 of the L-shaped rear bracket 88 defines corresponding concavely curved surfaces 108 adapted to receive arcuate, resilient damping pads or cushions 109 which provide shock absorbing, for vertical cushioning of the wheel mounting on the skate plate as discussed above with respect to the front wheel truck.

A wheel axle yoke 110 similar to that described above is provided for mounting a pair of rear wheels 21 on the mounting bracket 88 for swinging or tilting movement about an inclined axis. The wheel axle yoke 110 is formed by a central web 111 and opposed side arms 112 extending therefrom. The side arms 112 include apertures 114 mounting bushings 115 through which axle pins 116 extended and are secured by machine bolts 118. The wheels 21 which may have internal bearings 119 are mounted and supported on the axle pins 116. The yoke 110 is pivotally mounted on the vertical plate 90 of the rear mounting bracket 88. To this end, the yoke web 111 defines a concave spherical bearing surface 120 corresponding to and receiving the convex spherical surface 92 on the vertical mounting plate 90. A pivot pin 121 extends through corresponding apertures 122, 123 respectively in the bracket plate 90 and yoke web 111. The apertures 122, 123 and pivot pin 121 are aligned along an axis that is along an axis 124 that is inclined at an acute angle downwardly and forwardly with respect to the horizontal plane of the heel plate 29. The inclined pivot axis 124 and spherical bearing surfaces 92, 120 enable the wheels to tilt and turn when the skater leans one way or the other. The tilting movement is limited and controlled by a resilient U-shaped damping pad 125 mounted in a slot 126 in the horizontal plate 89 of the bracket, into which extends a tang 128 integral with the web of the rear wheel yoke 110. By varying the hardness and resiliency of the resilient damping pad 125, the swinging motion of the yoke and pair of rear wheels 21 can be controlled to suit the skater. The mounting plate and wheel yoke positions the rear pair of wheels slightly in back of the heel plate and thus in back of the skater's heel as shown in FIG. 4. This configuration enhances the skater's balance as well as making it easier to use the rear brake 40.

On both the front truck and the rear truck the mating surfaces between the wheel yoke and the vertical plate of the amounting bracket are spherical as described above. The mating surface of each corresponding mounting bracket plate is convex while the mating surface of each wheel yoke is concave. This configuration is similar to a ball and socket joint and allows the wheel yoke to pivot or rotate relative to be mounting bracket about the axis of rotation defined by the mounting pin. Both the axis of swivel 78 of the front pair of wheels and the axis of swivel 124 of the rear pair of wheels being longitudinal and at a downwardly acute angle with respect to the plane of the toe plate and heel plate allows the wheel pairs to tilt and turn as the skater leans to one side or the other, thereby providing a steering effect for skating on a curve or arc. If, for example, the skater leans to the left in order to turn along an arc to the left, the front pair of wheels pivot to the left while the rear pair of wheels pivot towards the right, thereby providing steering towards the left. Likewise, the same steering effect is obtained when the skater leans to the right in order to turn towards the right. In either case, the third wheel on the front truck does not pivot, thus providing stability during a turn in either direction, as well as during pushing by the skater using the side wheels to increase the speed of skating.

Figure 7:
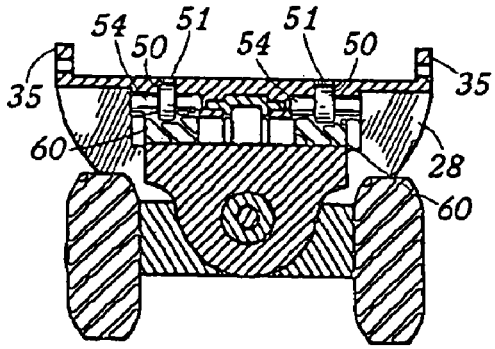
FIG. 7 is a section view taken substantially in the plane of line 7-7 on FIG. 4.

The wheels 21 are preferably of the type typically used in in-line skates which are formed of wear resistant polyurethane or other suitable plastic material affording durability and a long life. In line skate type wheels are preferred because they have a generally oval shaped cross-section when the cross-section includes or is taken along the wheel's rotational axis as shown in FIG. 7. The oval shape is preferred since it has a rounded tread surface which makes it easier for a skater to execute a turn. Conventional four wheeled roller skates typically have flat tread surfaces which make it more difficult for a skater to execute a turn since a skater using flat wheels cannot lean as much into a turn as a skater can with wheels having more rounded tread.

The front brake 39 consists of a brake pad 129 mounted on a brake bracket 130 secured to the underside of the toe plate. The rear brake 40 likewise includes a brake pad 131 secured to a bracket 132 mounted on the upstanding heel flange 32 at the rear of the heel plate. The flange 32 further serves as a heel stop engaging the heel of a skater's shoe.

Figure 5:
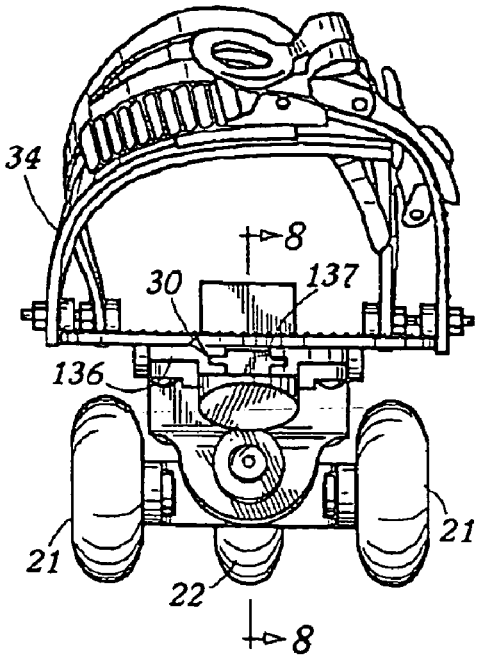
FIG. 5 is a front elevation view thereof taken substantially in the plane of line 5-5 on FIG. 4.
Figure 6:
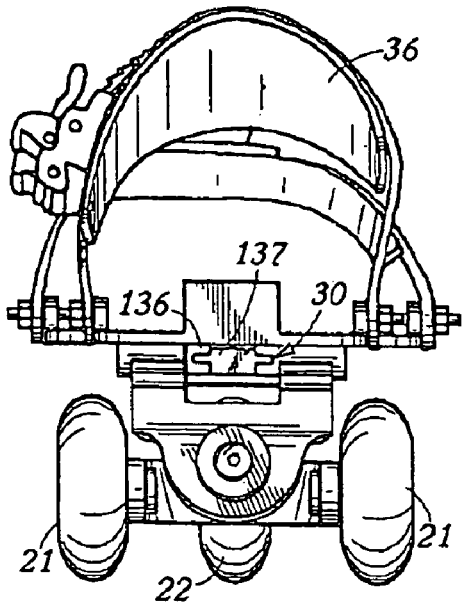
FIG. 6 is a rear elevation view thereof taken substantially in the plane of line 6-6 on FIG. 4.

The telescoping extension mechanism 30 enabling the toe plate 28 end heel plate 29 to be longitudinally adjusted relative to each other is formed by an elongated bar 135, cross-shaped in cross section, secured to the underside of the heel plate 29 and extending toward the toe plate 28, and a pair of elongated channels 136 secured to the toe plate with the channels facing each other as shown in FIG. 5. The bar 135 defines laterally projecting ribs 137 that are engaged in the channels 136 secured to the toe plate, thereby providing for telescoping adjustment. When the length adjustment of the toe and heel plates has been determined, the bar and channels are secured by the machine screws 96 utilized to mount the truck on the underside of the heel plate. The screws can be tightened or released to engage the channels and rod, thereby fixing the desired length of the skate. In addition, the skate structure is preferably formed of lightweight plastic or metal such as aluminum.

Skaters propel themselves on the skates by placing body weight on one skate and using the inside side wheels of the other skate to push. Because the skate wheels are pivotally mounted they tend to turn as the skater uses one skate to push. The third wheel at the front of the pushing skate provides stability and enables the skater to obtain a strong push or thrust. The third wheel on the front truck also affords stability to the skater during forward or backward skating, as well as when skating on uneven surfaces such as sidewalks, trails, and over sticks and stones.

Figure 3:
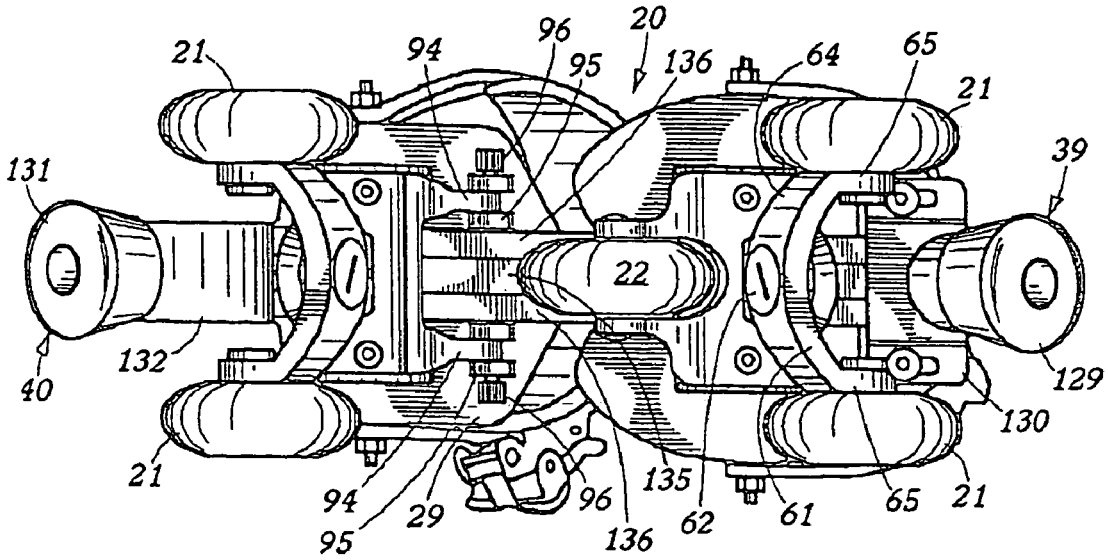
FIG. 3 is a bottom plan view thereof.
Figure 11:
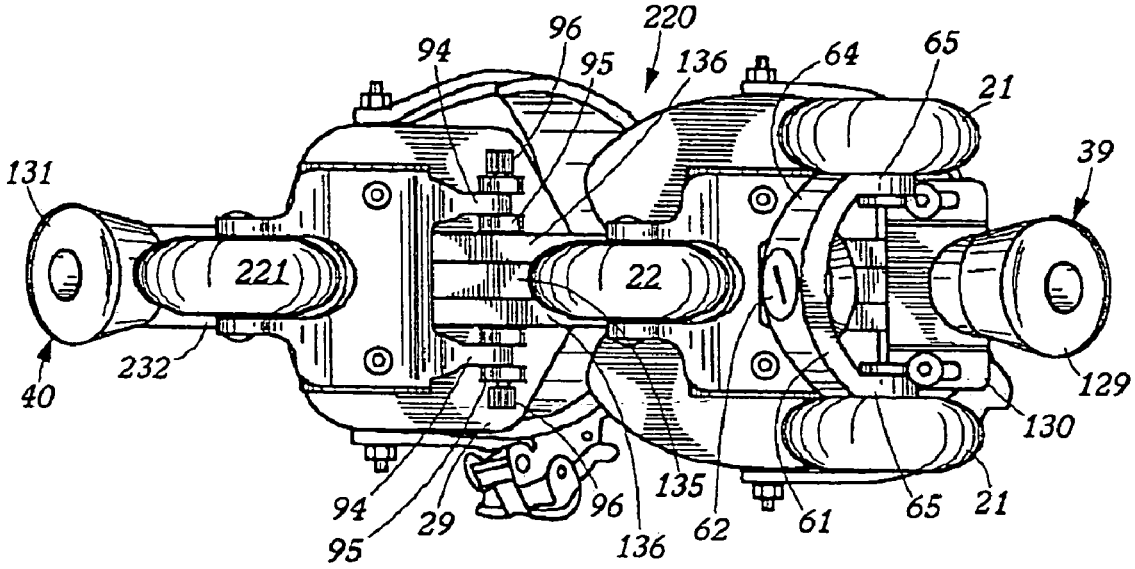
FIG. 11 is a bottom plan view of an embodiment of the present invention which is similar to that of FIG. 1 but which has only one rear wheel.
Figure 12:
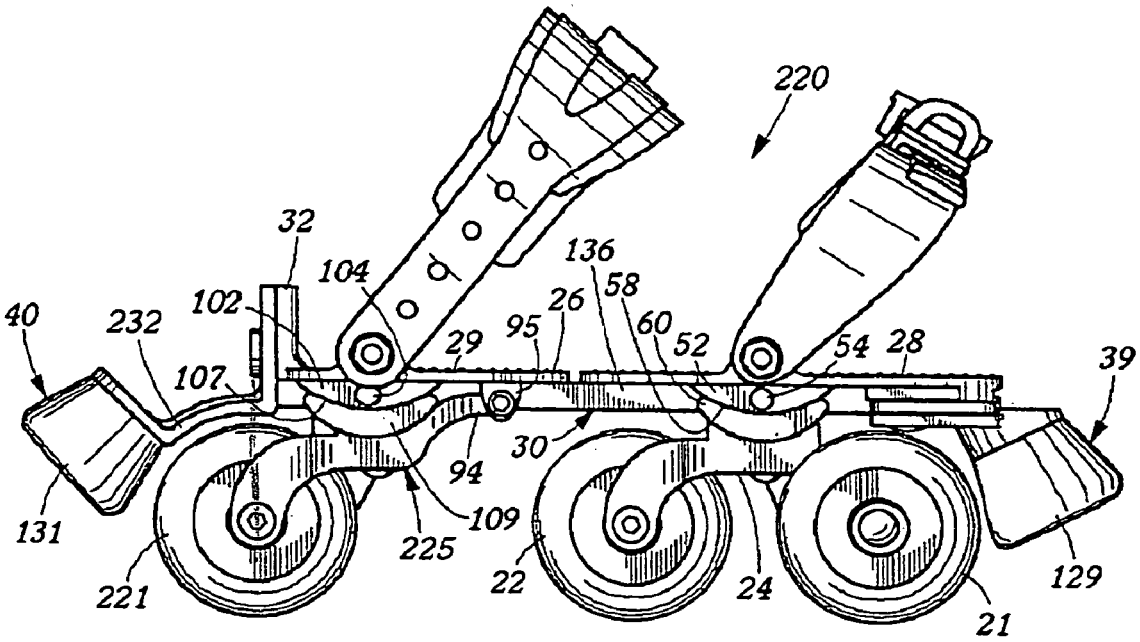
FIG. 12 is a side elevation view of the skate of FIG. 11.

FIGS. 11 and 12 illustrate a four wheeled roller skate 220 of the present invention which differs from skate 20 of the first embodiment in that it is only provided with one rear wheel 221 instead of the pair of rear wheels 21 illustrated in FIG. 3. As best shown in FIG. 11, rear wheel 221 is in line with the single center wheel 22 such that they both rotate in the same plane. Bracket 232 for rear brake 40 is also shaped differently than the bracket 132 for brake 40 of the first embodiment to prevent rear wheel 221 from contacting it should wheel 221 move upwardly due to the compression of pad 109 which could occur if a bump in the terrain were encountered. Rear truck 225 of this embodiment also differs from truck 25 of the first embodiment in that it only needs structure (not numbered) for mounting one wheel, i.e. wheel 221, not the pair of wheels 21 mounted on rear truck 25. The remaining components of skate 220 are identical to those of skate 20 and thus are numbered the same.

Skate 220 does not offer quite the stability of that provided by skate 20 but it is more maneuverable and lighter because it utilizes only one rear wheel.

The present invention also make possible a three wheeled skate (not shown) which would be similar to skate 220 but would not utilize center wheel 22, i.e. center wheel 22 would be removed from the skate. This skate would not be as stable as either skates 20 or 220 but it would be lightweight and very maneuverable. This skate would also not enable the skater to generate quite as much thrust as is possible with skates 20, 220 since the ability to push off the three wheel combination of the two front wheels 21 and the single center wheel 22 is what is believed to enable the generation of high thrust in the illustrated embodiments.

While this invention has been described as having preferred designs, it is understood that it is capable of further modifications, uses and/or adaptions following in general the principle of the invention and including such departures from the present disclosure as come within the known or customary practice in the art to which the invention pertains and as maybe applied to the central features hereinbefore set forth, and fall within the scope of the invention and the limits of the appended claims.

I Claim:

1. A roller skate comprising:

a platform for supporting a skater's foot; a front wheel truck secured to said platform;

a pair of front wheels rotatably mounted in transverse axial alignment on said front wheel truck, said front pair of wheels being mounted on said front wheel truck for tilting about the longitudinal axis of said platform;

a rear wheel truck secured to said platform;

one or more rear wheels rotatably mounted in parallel axial alignment with said front wheels on said rear wheel truck;

a single wheel rotatably mounted on said front wheel truck between said pairs of front and rear wheels in parallel axial alignment with said pairs of wheels; and a damping pad mounted on said front wheel truck for resiliently controlling tilting of said pair of front wheels about the longitudinal axis.

2. A roller skate as defined in claim 1 further comprising shock absorbing means located between said platform and said rear wheel truck for providing vertical cushioning of said rear truck wheel mounting on said platform.

3. A roller skate as defined in claim 1 comprising a pair of rear wheels rotatably mounted in transverse axial alignment on said rear wheel truck.

4. A roller skate as defined in claim 1 wherein said one or more rear wheels are positioned relative to said platform so that said one or more rear wheels are located behind the heel of the skater's foot when the skate is secured to the skater's foot.

5. A roller skate comprising:

a platform for supporting a skater's foot; a front wheel truck secured to said platform;

a pair of front wheels rotatably mounted in transverse axial alignment on said front wheel truck, said front pair of wheels being mounted on said front wheel truck for tilting about the longitudinal axis of said platform;

a rear wheel truck secured to said platform;

a pair of rear wheels rotatably mounted in transverse axial alignment on said rear wheel truck, said pairs of front and rear wheels being in parallel axial alignment with each other;

a single wheel rotatably mounted on said front wheel truck between said pairs of front and rear wheels in parallel axial alignment with said pairs of wheels; and a damping pad mounted on said front wheel truck for resiliently controlling tilting of said pair of front wheels about the longitudinal axis.

6. A roller skate as defined in claim 5 further comprising shock absorbing means located between said platform and said rear wheel truck for providing vertical cushioning of said rear truck wheel mounting on said platform.

7. A roller skate as defined in claim 6 wherein said rear pair of wheels is positioned relative to said platform so that said pair of rear wheels is located behind the heel of the skater's foot when the skate is secured to the skater's foot.

* * * * *